US011022928B2

(12) United States Patent
Satake et al.

(10) Patent No.: US 11,022,928 B2
(45) Date of Patent: Jun. 1, 2021

(54) CLEANING DEVICE AND IMAGE FORMING APPARATUS

(71) Applicant: KYOCERA Document Solutions Inc., Osaka (JP)

(72) Inventors: Kenichi Satake, Osaka (JP); Hiroatsu Tamai, Osaka (JP); Takeshi Watanabe, Osaka (JP); Hiroki Sakane, Osaka (JP); Yusuke Tamekuni, Osaka (JP); Masato Usui, Osaka (JP); Yuzuru Yuasa, Osaka (JP); Yasuhiro Michishita, Osaka (JP); Naoto Miyakoshi, Osaka (JP); Shunsuke Yamasaki, Osaka (JP); Shinobu Ohata, Osaka (JP)

(73) Assignee: KYOCERA Document Solutions Inc.

( * ) Notice: Subject to any disclaimer, the term of this patent is extended or adjusted under 35 U.S.C. 154(b) by 0 days.

(21) Appl. No.: 16/885,957

(22) Filed: May 28, 2020

(65) Prior Publication Data

US 2020/0379380 A1 Dec. 3, 2020

(30) Foreign Application Priority Data

May 30, 2019 (JP) ..... JP2019-101701
Sep. 26, 2019 (JP) ..... JP2019-175380

(51) Int. Cl.
*G03G 21/00* (2006.01)
*G03G 15/20* (2006.01)
*G03G 15/08* (2006.01)

(52) U.S. Cl.
CPC ..... *G03G 21/00* (2013.01); *G03G 15/0808* (2013.01); *G03G 15/0887* (2013.01); *G03G 15/2025* (2013.01)

(58) Field of Classification Search
CPC .... G03G 15/65; G03G 15/6529; G03G 21/00; B41J 29/17
See application file for complete search history.

(56) References Cited

U.S. PATENT DOCUMENTS

2014/0284177 A1* 9/2014 Chiba ..... B41J 11/007 198/497
2018/0095389 A1* 4/2018 Satoh ..... G03G 15/2025

FOREIGN PATENT DOCUMENTS

JP 2004-345805 12/2004

* cited by examiner

*Primary Examiner* — Thomas S Giampaolo, II
(74) *Attorney, Agent, or Firm* — Gerald E. Hespos; Michael J. Porco; Matthew T. Hespos

(57) ABSTRACT

A cleaning device includes a sheet conveyance roller, and a cleaning unit that cleans a surface of the sheet conveyance roller. The cleaning unit includes a cleaning member that can come in contact with the surface of the sheet conveyance roller, and a pressing roller that presses the cleaning member against the surface of the sheet conveyance roller. The pressing roller includes a low Young's modulus area formed at least on a part of the pressing roller in a radial direction, the low Young's modulus area having a Young's modulus lower than a Young's modulus of the sheet conveyance roller. When the surface of the sheet conveyance roller is cleaned, the pressing roller is pressed against the sheet conveyance roller so as to elastically deform in the radial direction in a state where the cleaning member is sandwiched between the pressing roller and the sheet conveyance roller.

12 Claims, 14 Drawing Sheets

CLEANING DEVICE AND IMAGE FORMING APPARATUS

INCORPORATION BY REFERENCE

This application is based on Japanese Patent Application No. 2019-101701 filed with the Japanese Patent Office on May 30, 2019 and Japanese Patent Application No. 2019-175380 filed with the Japanese Patent Office on Sep. 26, 2019, the contents of which are incorporated by reference.

BACKGROUND

Field of the Invention

The present disclosure relates to a cleaning device which cleans a sheet conveyance member, such as a conveyance roller and a conveyance belt that conveys a sheet, and to an image forming apparatus including the cleaning device.

Related Art

The image forming apparatus, such as a printer, includes a sheet conveyance unit which conveys a sheet to an image forming unit that executes image forming processing. The sheet conveyance unit includes, for example, a pair of resist rollers each having a length corresponding to a width of the sheet to be conveyed. The pair of resist rollers forms a nip portion through which the sheet travels. When a distal end portion of the sheet is brought into contact with the nip portion in a state where the rotation of the pair of resist rollers is stopped, skewing of the sheet is straightened. Afterward, when the pair of resist rollers rotates, the sheet is conveyed into the nip portion and then is fed out from there at proper timing matching timing of image forming at the image forming position.

Another example of the sheet conveyance unit is a sheet conveyance unit including a plurality of support rollers and a conveyance belt supported in an extended manner between the plurality of support rollers. The sheet conveyance unit having such a configuration drives the conveyance belt at predetermined timing, thereby conveying the sheet placed on the conveyance belt to the image forming unit.

There is a case where a surface of the sheet conveyance member, such as the resist roller and the conveyance belt, is soiled because of sheet conveyance. Soiling of the surface of the sheet conveyance member may create a problem, such as an image to be printed on the sheet being stained with foreign matter. A conventional technique has been disclosed as a configuration in which a web of a strip shape is brought into contact with one resist roller out of a pair of resist rollers. A predetermined amount of the web is fed out periodically from a feed-out roller, and this predetermined amount of the web fed out is taken up by a take-up roller. Between the feed-out roller and the take-up roller, the web comes in contact with an outer peripheral surface of the one resist roller, and wipes paper dust away from the outer peripheral surface to clean the outer peripheral surface.

SUMMARY

A cleaning device according to an aspect of the present disclosure includes: a sheet conveyance roller that conveys a sheet in an image forming apparatus that executes image forming processing, using a recording member; and a cleaning unit that cleans a surface of the sheet conveyance roller.

The cleaning unit includes: a cleaning member configured to come in contact with the surface of the sheet conveyance roller; and a pressing roller that presses the cleaning member against the surface of the sheet conveyance roller. The pressing roller includes a low Young's modulus area formed at least on a part of the pressing roller in a radial direction, the low Young's modulus area having a Young's modulus lower than a Young's modulus of the sheet conveyance roller. When the surface of the sheet conveyance roller is cleaned, the pressing roller is pressed against the sheet conveyance roller so as to elastically deform in the radial direction in a state where the cleaning member is sandwiched between the pressing roller and the sheet conveyance roller.

A cleaning device according to another aspect of the present disclosure includes a sheet conveyance belt supported in an extended manner between a plurality of support rollers. The cleaning unit includes: a cleaning member configured to come in contact with the surface of the sheet conveyance belt; and a pressing roller that presses the cleaning member against one support roller out of the plurality of support rollers. The pressing roller includes a low Young's modulus area formed at least on a part of the pressing roller in a radial direction, the low Young's modulus area having a Young's modulus lower than a Young's modulus of the one support roller. When the surface of the sheet conveyance belt is cleaned, the pressing roller is pressed against the one support roller so as to elastically deform in the radial direction in a state where the cleaning member and the sheet conveyance belt are sandwiched between the pressing roller and the one support roller.

An image forming apparatus according to still another aspect of the present disclosure includes: an image forming unit that executes image forming processing, using a recording material; a sheet conveyance unit that conveys a sheet to the image forming unit, the sheet conveyance unit including a sheet conveyance member that comes in contact with the sheet; and the above cleaning device.

DETAILED DESCRIPTION

Embodiments of the present disclosure will hereinafter be described with reference to the drawings. The embodiments to be described below are examples of the present disclosure, and the present disclosure, except its essential configurations, is not limited in any form by the following embodiments.

First Embodiment

<Overall Configuration of Image Forming Apparatus>

Figure 1:
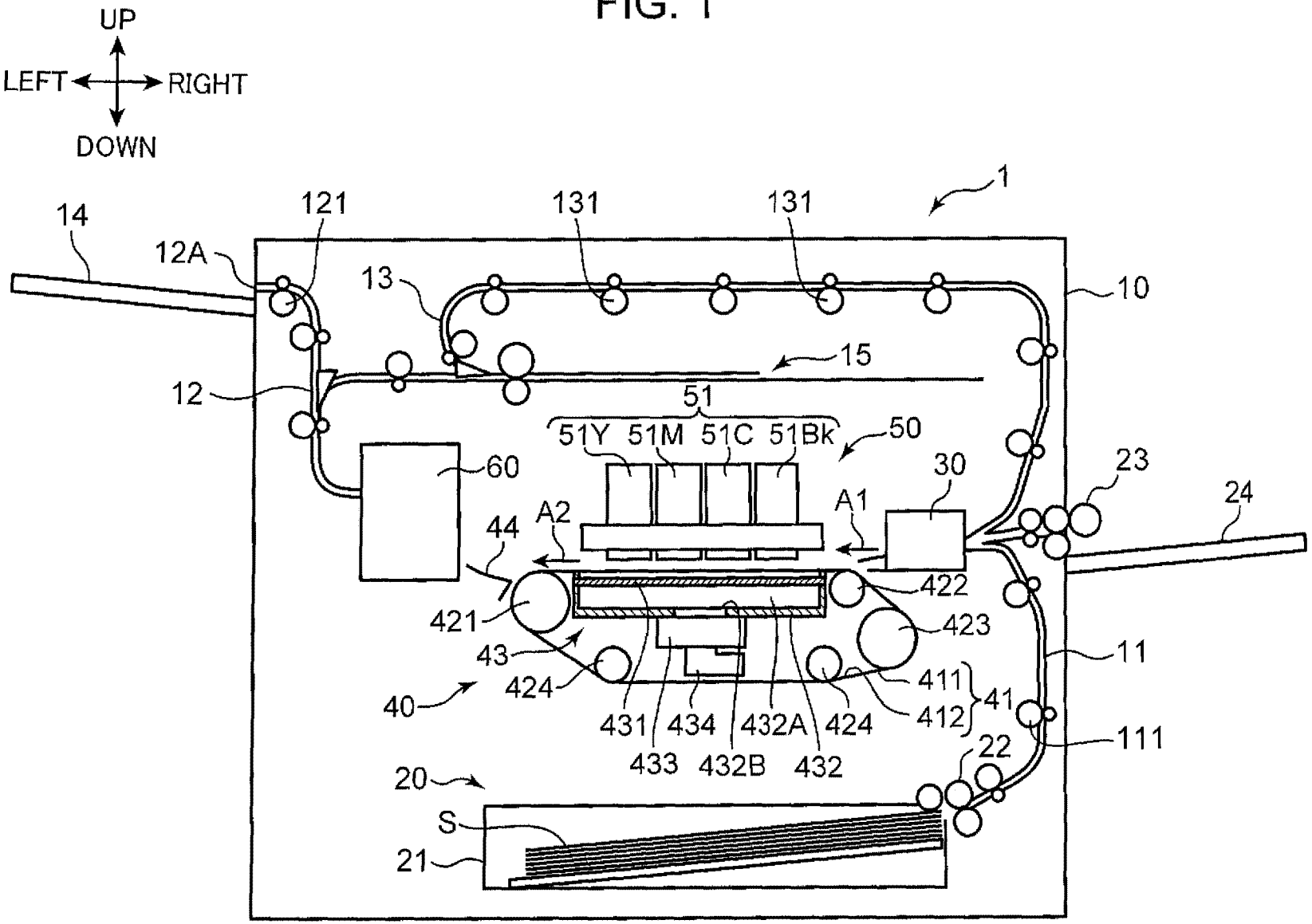
FIG. 1 is a schematic cross-sectional view showing an internal structure of an image forming apparatus according to an embodiment of the present disclosure.

FIG. 1 depicts an internal structure of an image forming apparatus 1 according a first embodiment of the present disclosure. The image forming apparatus 1 shown in FIG. 1 is an ink jet recording apparatus which forms (records) an image on a sheet S by ejecting droplets of water-based ink (recording material). The image forming apparatus 1 includes an apparatus body 10, a paper supply unit 20, a resist roller unit (sheet conveyance unit) 30, a belt conveyance unit 40, an image forming unit 50, and a curl correction unit 60.

The apparatus body 10 is a box-shaped housing that houses various devices for forming an image on the sheet S. In the apparatus body 10, a first conveyance path 11, a second conveyance path 12, and a third conveyance path 13 which form a conveyance path of the sheet S are formed.

The paper supply unit 20 supplies the sheet S to the first conveyance path 11. The paper supply unit 20 includes a paper supply cassette 21 and a paper supply roller 22. The paper supply cassette 21 is detachably mounted on the apparatus body 10 and sheets S are stored in the paper supply cassette 21. The paper supply roller 22 feeds out sheets S stored in the paper supply cassette 21 one by one, by picking a sheet S on an uppermost layer of a bundle of sheets S and sending the sheet S out to a first conveyance path 11.

The sheet S supplied to the first conveyance path 11 is conveyed by a pair of first conveyance rollers 111 provided on the first conveyance path 11, to a resist roller unit 30 disposed on a downstream side of the first conveyance path 11. A paper supply tray 24 is disposed on a right side surface of the apparatus body 10, and sheets S can be manually placed on an upper surface of the paper supply tray 24. The sheets S placed on the paper supply tray 24 are fed out toward the resist roller unit 30 by the paper supply roller 23.

The resist roller unit 30 is a device that conveys the sheet S, which is fed to the resist roller unit 30 through the first conveyance path 11 or the paper supply roller 23, toward a conveyance belt 41 of the belt conveyance unit 40 in a sheet conveyance direction A1. Details of the resist roller unit 30 are described later.

When a distal end of the sheet S conveyed by the resist roller unit 30 comes in contact with an outer peripheral surface 411 of the conveyance belt 41, the sheet S is then conveyed by the conveyance belt 41, which is being driven, in a sheet conveyance direction A2 in a state where the sheet S is held on the outer peripheral surface 411. The sheet conveyance direction A2 is a direction in which the sheet S is conveyed from the right side to the left side in a left-right direction.

The belt conveyance unit 40 is disposed under the image forming unit 50 so as to face line heads 51. The belt conveyance unit 40 conveys the sheet S, which is conveyed by the resist roller unit 30, in the sheet conveyance direction A2 toward the curl correction unit 60 such that the sheet S passes under the image forming unit 50. The belt conveyance unit 40 has the conveyance belt 41 and a suction unit 43.

The conveyance belt 41 is an endless belt having a width in a front-rear direction (direction orthogonal to the paper surface in FIG. 1) and extending in a left-right direction. The conveyance belt 41 is disposed so as to face the image forming unit 50, and conveys the sheet S in the sheet conveyance direction A2 on an outer peripheral surface 411. More specifically, in a predetermined conveyance area facing the line heads 51 of the image forming unit 50, the conveyance belt 41 conveys the sheet S held on its outer peripheral surface 411, in the sheet conveyance direction A2. An image forming position, at which the line heads 51 of the image forming unit 50 carry out image forming processing, is set on an orbital movement path of the conveyance belt 41.

The conveyance belt 41 is supported in an extended manner between and by the first support roller 421, the second support roller 422, the third support roller 423, and the pair of fourth support rollers 424. Inside the conveyance belt 41 supported in an extended manner as described above, the suction unit 43 is disposed so as to face an inner peripheral surface 412. The first support roller 421 is a drive roller extending in the front-rear direction that is a width direction of the conveyance belt 41. In the sheet conveyance direction A2, the first support roller 421 is disposed downstream to the suction unit 43. The first support roller 421 is rotatably driven by a drive motor (not shown), and allows the conveyance belt 41 to orbit in a predetermined orbital direction. As a result of an orbital movement of the conveyance belt 41, the sheet S held on the outer peripheral surface 411 of the conveyance belt 41 is conveyed in the sheet conveyance direction A2.

The second support roller 422 is a belt speed detection roller extending in the front-rear direction. In the sheet conveyance direction A2, the second support roller 422 is disposed upstream to the suction unit 43. The second support roller 422 is disposed such that the second support roller 422 cooperates with the first support roller 421 to maintain the planarity of an area of the outer peripheral surface 411 of the conveyance belt 41, the area facing the line heads 51, and the planarity of an area of the inner peripheral surface 412 of the conveyance belt 41, the area facing the suction unit 43. On the outer peripheral surface 411 of the conveyance belt 41, an area facing the line heads 51 and located between the first support roller 421 and the second support roller 422 serves as the above predetermined conveyance area where the sheet S held on the outer peripheral surface 411 is conveyed. The second support roller 422 is driven to rotate in a movement interlocked with the orbiting of the conveyance belt 41. The second support roller 422 is fitted with a pulse plate (not shown). This pulse plate rotates integrally with the second support roller 422. By measuring a rotating speed of the pulse plate, a rotating speed of the conveyance belt 41 is detected.

The third support roller 423 is a tension roller extending in the front-rear direction, and gives the conveyance belt 41 a tensile force to prevent the conveyance belt 41 from slacking. The third support roller 423 is driven to rotate in a movement interlocked with the orbiting of the conveyance belt 41. Each of the pair of fourth support rollers 424 is a guide roller extending in the front-rear direction, and guides the conveyance belt 41 to cause it to pass under the suction unit 43. The pair of fourth support rollers 424 is driven to rotate in a movement interlocked with the orbiting of the conveyance belt 41. The conveyance belt 41 has a plurality of suction holes penetrating the conveyance belt 41 in its thickness direction from the outer peripheral surface 411 to the inner peripheral surface 412.

The suction unit 43 is disposed so as to face the image forming unit 50 with the conveyance belt 41 interposed between the suction unit 43 and the image forming unit 50. The suction unit 43 brings the sheet S, which is held on the outer peripheral surface 411 of the conveyance belt 41, into close contact with the outer peripheral surface 411 of the conveyance belt 41 by generating a negative pressure between the sheet S and the conveyance belt 41. The suction unit 43 includes a belt guide member 431, a suction housing 432, a suction device 433, and an exhaust duct 434.

The belt guide member 431 is disposed so as to face an area of the inner peripheral surface 412 of the conveyance belt 41, the area being located between the first support roller 421 and a second support roller 422. The belt guide member 431 is a plate-like member having a width substantially equal to a length of the conveyance belt 41 in its width direction (front-rear direction). The belt guide member 431 forms an upper surface portion of the suction housing 432, and has a shape that is substantially equal to a shape of the suction housing 432 when seen from above. The belt guide member 431 guides the orbital movement of the conveyance belt 41 in an interlocking manner with the rotation of the first support roller 421 between the first support roller 421 and the second support roller 422.

The belt guide member 431 has a plurality of groove portions formed on a belt guide surface facing the inner peripheral surface 412 of the conveyance belt 41. The groove portions are formed so as to correspond respectively to the suction holes of the conveyance belt 41. The belt guide member 431 further has through-holes formed so as to correspond respectively to the groove portions. Each through-hole is a hole that in each groove portion, penetrates the belt guide member 431 in its thickness direction. Each through-hole thus communicates with each suction hole of the conveyance belt 41 across each groove portion.

The suction unit 43 configured in the above manner generates a suction force by sucking air from a space above the conveyance belt 41 through the groove portions and through-holes of the belt guide member 431 and the suction holes of the conveyance belt 41. Due to such a suction force, an airflow (suction air) toward the suction unit 43 is generated in the space above the conveyance belt 41. When the sheet S is conveyed onto the conveyance belt 41 by the resist roller unit 30 and covers a part of the outer peripheral surface 411 of the conveyance belt 41, a suction force (negative pressure) acts on the sheet S, and the sheet S is brought into close contact with the outer peripheral surface 411 of the conveyance belt 41.

The suction housing 432 is a box-shaped housing having an upper opening, and the suction housing 432 is disposed below the conveyance belt 41 such that the upper opening is covered by the belt guide member 431. The suction housing 432 defines a suction space 432A in cooperation with the belt guide member 431. This means that a space enclosed with the suction housing 432 and the belt guide member 431 serves as the suction space 432A. This suction space 432A communicate with the suction holes of the conveyance belt 41 through the groove portions and through-holes of the belt guide member 431.

An opening portion 432B is formed in a bottom wall portion of the suction housing 432, and the suction device 433 is disposed corresponding to the opening portion 432B. The exhaust duct 434 is connected to the suction device 433. The exhaust duct 434 is connected to an exhaust port (not shown) formed in the apparatus body 10.

The image forming unit 50 is disposed above the belt conveyance unit 40. Specifically, above the belt conveyance unit 40, the image forming unit 50 is disposed so as to face the outer peripheral surface 411 of the conveyance belt 41. The image forming unit 50 forms an image by applying image forming processing to the sheet S which is conveyed in the sheet conveyance direction A2 in a state where the sheet S is held on the outer peripheral surface 411 of the conveyance belt 41. In the present embodiment, an image forming method of the image forming unit 50 is an ink jet method, according to which an image is formed on the sheet S by ejecting droplets of water-based ink (recording material).

The image forming unit 50 includes line heads 51 (51Bk, 51C, 51M, 51Y). The line head 51Bk ejects black ink droplets, the line head 51C ejects cyan ink droplets, the line head 51M ejects magenta ink droplets, and the line head 51Y ejects yellow ink droplets. The line heads 51Bk, 51C, 51M, and 51Y are arranged adjacent to each other from an upstream side to a downstream side in the sheet conveyance direction A1. Each of the line heads 51Bk, 51C, 51M, and 51Y ejects ink droplets on the sheet S conveyed in the sheet conveyance direction A2 in a state where the sheet S is held on the outer peripheral surface 411 of the conveyance belt 41, thereby forming an image on the sheet S. As a result, an image is formed on the sheet S.

The sheet S on which the image is formed is conveyed by the conveyance belt 41, and is guided by a discharge guide unit 44 to enter the curl correction unit 60. The curl correction unit 60 is disposed downstream of the conveyance belt 41 in the sheet conveyance direction A2 with the discharge guide unit 44 sandwiched therebetween. The curl correction unit 60 corrects the curl of the sheet S on which the image is formed while conveying the sheet S to the downstream side.

The sheet S whose curl has been corrected by the curl correction unit 60 is fed out to the second conveyance path 12. The second conveyance path 12 extends along a left side surface of the apparatus body 10. The sheet S fed out to the second conveyance path 12 is conveyed by a pair of second conveyance rollers 121 disposed on the second conveyance path 12 toward a paper discharge port 12A formed on a left side of the apparatus body 10, and the sheet S is discharged onto a paper discharge unit 14 from the paper discharge port 12A.

In a case where both-side printing is applied to the sheet S, meanwhile, the sheet S, whose front surface has been subjected to the image forming processing, is fed out from the second conveyance path 12 toward a sheet reversing unit 15. The sheet reversing unit 15 is a conveyance path branching out from a midpoint of the second conveyance path 12, serving as a part where the sheet S is reversed in surface position and conveyance direction (switchback). The sheet S reversed by the sheet reversing unit 15 to have its front and back surfaces switched to each other is fed out to a third conveyance path 13, on which the sheet S is conveyed in a reverse direction by a pair of third conveyance rollers 131 disposed on the third conveyance path 13. Subsequently, the sheet S travels through the resist roller unit 30 and is re-supplied onto the outer peripheral surface 411 of the conveyance belt 41 in a state where the sheet S is reversed to have its front and back surfaces switched to each other. The re-supplied sheet S is conveyed by the conveyance belt 41 as the image forming processing is applied to the back surface of the sheet S by the image forming unit 50. The sheet S on which both-side printing has been completed passes through the second conveyance path 12, and is discharged onto the paper discharge unit 14 from the paper discharge port 12A.

<Structure of Resist Roller Unit and its Surroundings>

Figure 2:
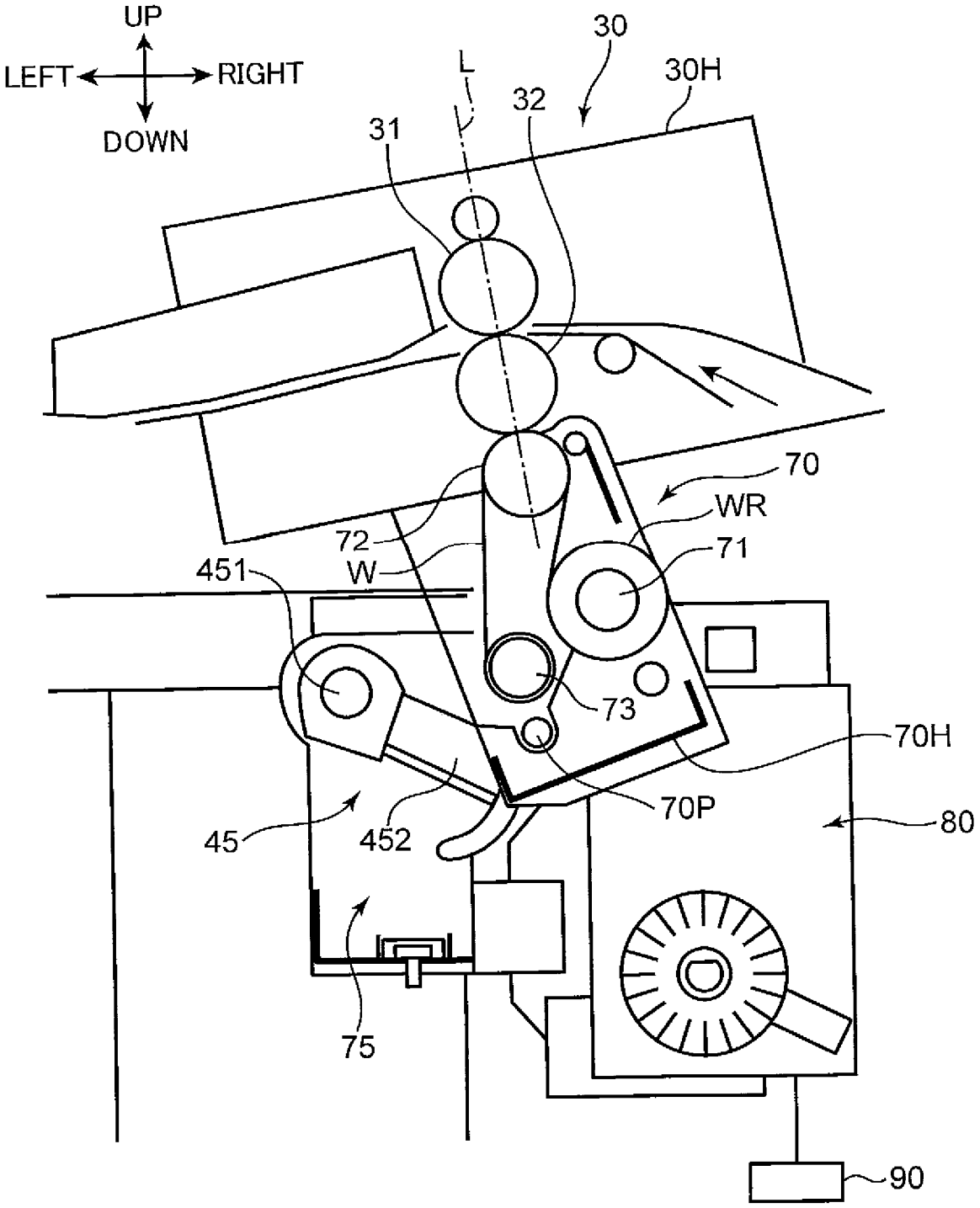
FIG. 2 is a cross-sectional view showing a structure of a resist roller unit, a cleaning unit, and their surroundings.

FIG. 2 shows a structure of the resist roller unit 30 and its surroundings. As shown in FIG. 2, the resist roller unit 30 has a resist housing 30H, and a pair of resist rollers consisting of a resist upper roller 31 and a resist lower roller 32 (sheet conveyance roller). The resist housing 30H is mounted on the apparatus body 10, and rotatably supports the resist upper roller 31 and the resist lower roller 32. In the resist housing 30H, the sheet S is conveyed into a nip portion formed between the pair of resist rollers consisting of the resist upper roller 31 and the resist lower roller 32. The resist roller unit 30 has a roller drive unit (not shown) that drives the resist upper roller 31 and the resist lower roller 32 to rotate.

The resist upper roller 31 is a metal roller made of, for example, an aluminum alloy. The resist lower roller 32 is constructed by coating an outer peripheral surface of a roller base material made of a solid, hard rubber layer, with a highly water-repellent tube. A structure of the resist lower roller 32 will be described in detail later with reference to FIG. 12. The resist lower roller 32 forms the nip portion between the resist lower roller 32 and the resist upper roller 31, the nip portion allowing the sheet S to travel therethrough, and conveys the sheet S toward the image forming unit 50 at timing matching timing of the image forming processing.

As shown in FIG. 2, a virtual straight line L connecting the center of the resist upper roller 31 and the center of the resist lower roller 32 is inclined at an acute angle (e.g., 10 degrees) with respect to a vertical direction. In other words, the resist lower roller 32 is disposed at the position displaced upstream in a conveyance direction of the sheet S with respect to the resist upper roller 31.

When the above both-side printing is carried out, the sheet S having been subjected to single-side printing is reversed to have its front and back surfaces switched to each other, and is conveyed into the nip portion of the pair of resist rollers. As a result, the resist lower roller 32 comes in contact with a printed surface of the sheet S. At this time, undried ink adheres to a surface of the resist lower roller 32 in some cases. Such a case leads to a problem that ink adhering to the resist lower roller 32 is transferred to another incoming sheet S when it travels through the pair of resist rollers. Another concern is that the resist lower roller 32 disposed on the lower side out of the pair of resist rollers is a roller that allows foreign matter, such as paper dust, to adhere thereto easily.

In view of the above circumstances, the image forming apparatus 1 according to the present embodiment is provided with a cleaning unit 70 (cleaning device) and with a movement mechanism 75. The cleaning unit 70 can clean a surface of the resist lower roller 32. The cleaning unit 70, of which a detailed structure will be described later, includes a web driven roller 71, a pressing roller 72, a web drive roller 73, a cleaning housing 70H that pivotally supports these rollers 71 to 73, and a web W.

The web W is a strip-shaped member forming a contact surface that comes in contact with the surface of the resist lower roller 32 to clean up the surface. The web W is made of a fabric material, such as nonwoven fabric, and is rolled in advance into a web roll WR, which is fitted on the exterior of the web driven roller 71. The web W is fed out by fixed amount from the web roll WR fitted on the web driven roller 71, travels the pressing roller 72 past, and is rolled up around the web drive roller 73. The web W is supported in an extended manner between the web driven roller 71, the pressing roller 72, and the web drive roller 73 so as to have no slackness.

The movement mechanism 75 (FIG. 2) is a mechanism that allows the cleaning unit 70 to be moved between a cleaning position (FIG. 2) and a mounting and removing position (FIG. 7) below the cleaning position. At the cleaning position, the movement mechanism 75 allows the web W of a cleaning part 70A to come in contact with the resist lower roller 32. At the mounting and removing position, the movement mechanism 75 allows the cleaning part 70A to be disposed below the resist lower roller 32 in a separated manner and allows the cleaning unit 70 to be mounted and removed on and from the apparatus body 10. The movement mechanism 75 can cause the cleaning unit 70 to stay at a separation position located at a midpoint between the cleaning position and the mounting and removing position. At the separation position, the cleaning part 70A is disposed below the resist lower roller 32 in a separated manner as the cleaning unit 70 is disconnected from a web feed-out mechanism.

The movement mechanism 75 has a cleaning unit rotating unit 45 and a unit driving unit 80 that cause the cleaning unit 70 to rotate such that the cleaning unit 70 changes its orientation between the cleaning position and the mounting and removing position. The cleaning unit rotating unit 45 includes a rotary shaft 451 supported on the conveyance unit frame 40H holding the belt conveyance unit 40, and a pair of front and rear rotary levers 452 fitted respectively to front and rear parts of the rotary shaft 451.

The unit driving unit 80 includes a drive motor (not shown), and generates a drive force for rotating the rotary shaft 451 around its center axis. Being driven by rotation of the drive motor, the rotary shaft 451 is caused to rotate by a predetermined angle. To the drive motor of the unit driving unit 80, a controller 90 is connected. The drive motor is rotatably driven according to a control signal from the controller 90. The controller 90 is configured such that in a computer system including a CPU, ROM, RAM and the like, the controller 90 executes a predetermined operation program.

The rotary levers 452 have pin receiving portions 452P (FIG. 8) formed respectively thereon. The pin receiving portions 452P receive unit fulcrum pins 70P protruding in the front-rear direction from front and rear parts of the cleaning unit 70, respectively, and rotatably support the unit fulcrum pins 70P. The cleaning unit 70 is controlled in orientation to take its respective orientations at three positions, i.e., the cleaning position, the separation position, and the mounting and removing position, according to angels of rotation of the rotary shaft 451 rotated by the unit driving unit 80. A state shown in FIG. 2 is a state where the cleaning unit 70 is at the cleaning position at which the pressing roller 72 is in contact with the resist lower roller 32 with the web W sandwiched between the pressing roller 72 and the resist lower roller 32.

When the cleaning unit 70 is at the separation position, the pressing roller 72 is disposed below in a separated manner so that the web W is separated from the resist lower roller 32. When the cleaning unit 70 is at the mounting and removing position, the pressing roller 72 is disposed further below in a separated manner.

<Detailed Structure of Cleaning Unit>

Figure 3:
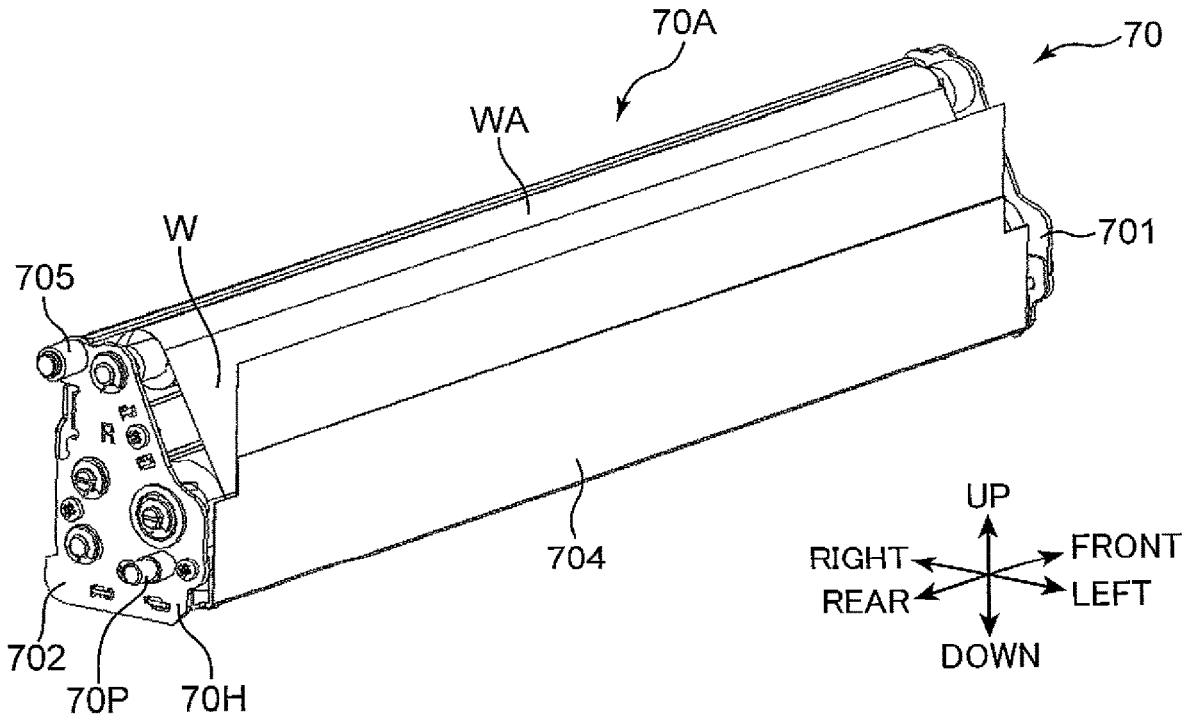
FIG. 3 is a perspective view showing an external structure of the cleaning unit.
Figure 4:
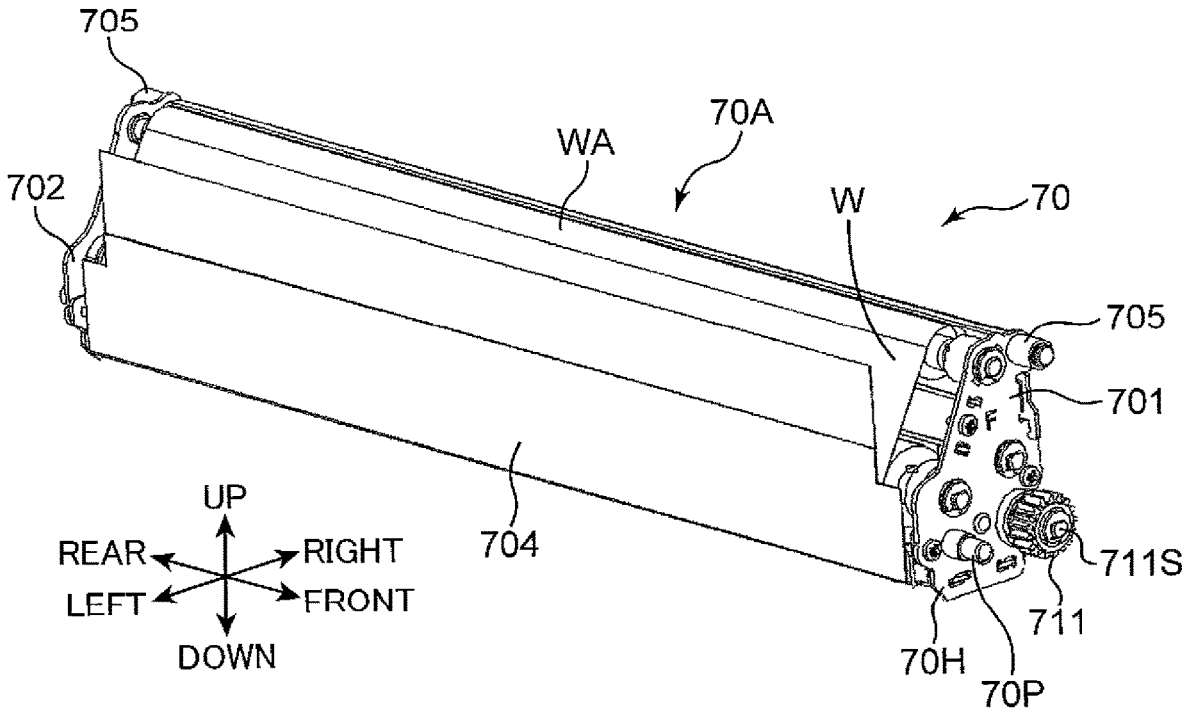
FIG. 4 is a perspective view showing an external structure of the cleaning unit.
Figure 5:
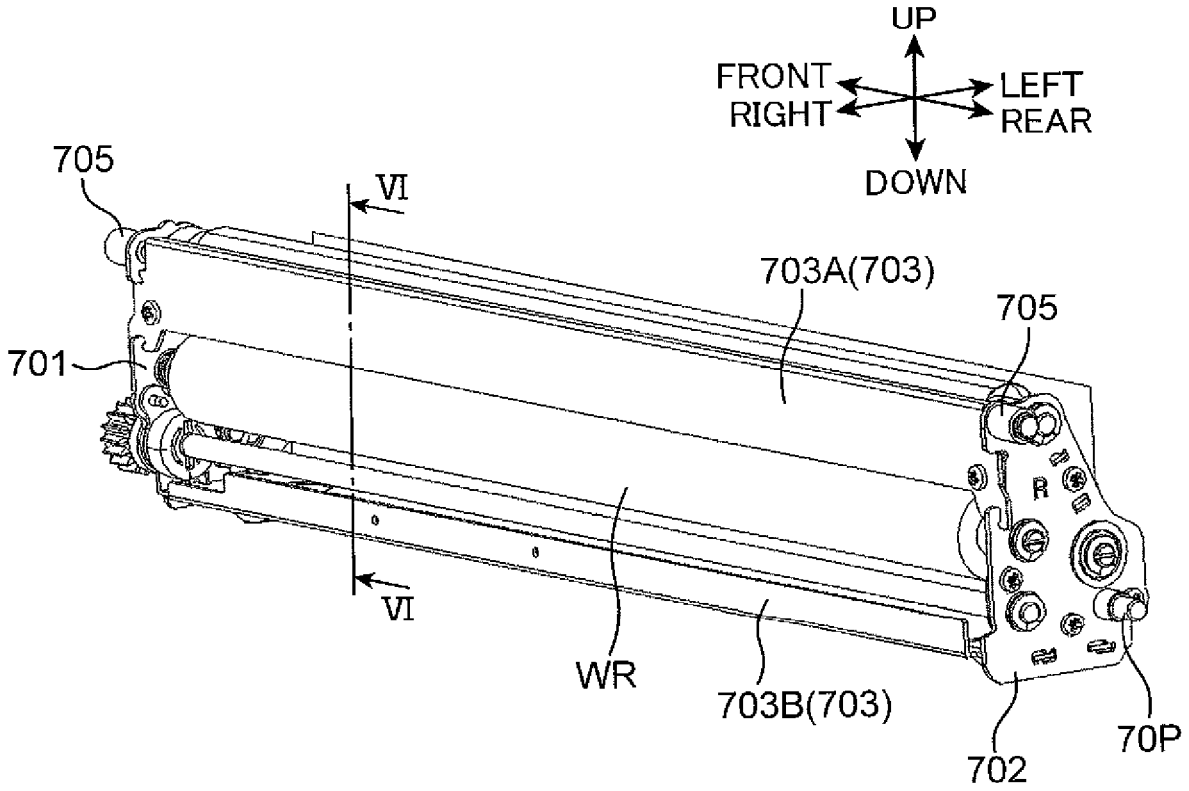
FIG. 5 is a perspective view showing an external structure of the cleaning unit.
Figure 6:
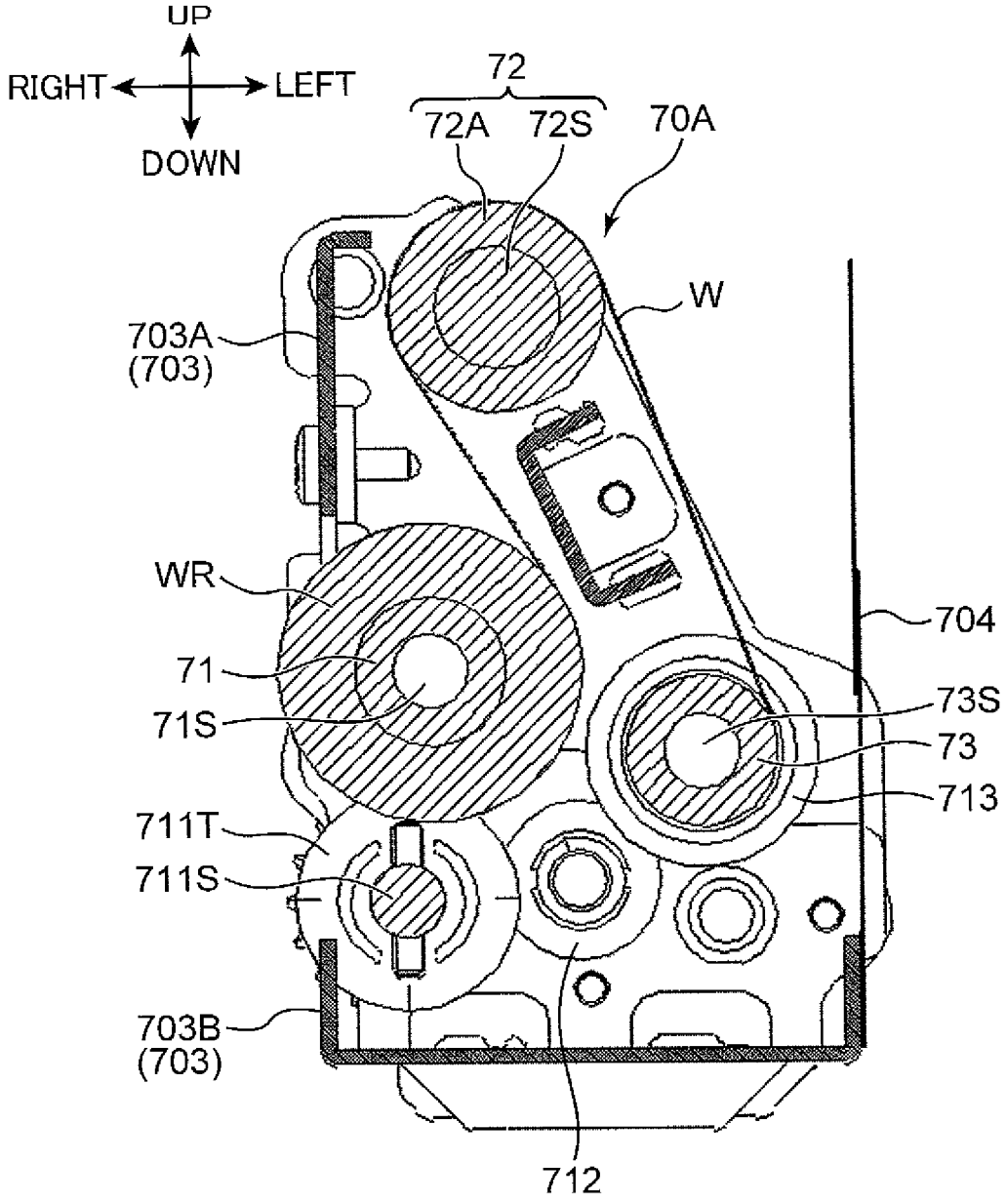
FIG. 6 is a cross-sectional view taken along line VI-VI in FIG. 5.

FIGS. 3 to 5 are perspective views of an external structure of the cleaning unit, showing the external structure of the cleaning unit seen in different directions. FIG. 6 is a cross-sectional view taken along line VI-VI in FIG. 5. The cleaning unit 70 includes the cleaning part 70A and the cleaning housing 70H. The cleaning part 70A has a contact surface WA extending along an axial direction of the resist lower roller 32. The cleaning part 70A is disposed such that the contact surface WA comes in contact from below with the surface of the resist lower roller 32, and the contact surface WA wipes out the surface of the resist lower roller 32 to clean up the surface.

The cleaning housing 70H supports the cleaning part 70A. The cleaning housing 70H has a front wall 701 and a rear wall 702, a connection wall 703, the pair of unit fulcrum pins 70P, a sheet member 704, and a pair of guide rollers 705. The front wall 701, the rear wall 702, and the connection wall 703 of the cleaning housing 70H are made of a metal material (magnetic material).

The front wall 701 and the rear wall 702 are disposed so as to face each other in the front-rear direction (the axial direction of the resist lower roller 32), and support the cleaning part 70A. The connection wall 703 connects the front wall 701 to the rear wall 702 along the front-rear direction. The connection wall 703 has a side wall 703A making up an upper right side surface of the cleaning housing 70H, and a bottom wall 703B making up a bottom surface of the cleaning housing 70H (see FIG. 6).

The pair of unit fulcrum pins 70P protrude in the front-rear direction from an outer surface of the front wall 701 and the same of the rear wall 702, respectively. The unit fulcrum pins 70P are disposed on a left lower portion of the front wall 701 and the same of the rear wall 702, respectively. Each unit fulcrum pin 70P has a circular cylindrical shape in two stages where an outer diameter of the unit fulcrum pin 70P decreases from a base portion toward a distal end portion.

The sheet member 704 is a film-like member making up a left side surface of the cleaning housing 70H, and is fixed to the bottom wall 703B (FIG. 6). The sheet member 704 prevents foreign matter, such as paper dust and ink pigment, collected by the cleaning unit 70 from scattering in the apparatus body 10.

Above the unit fulcrum pins 70P, the pair of guide rollers 705 are supported by the front wall 701 and the rear wall 702, respectively, and each include an outer peripheral surface rotatable around a center axis parallel to the front-rear direction. The guide rollers 705 are disposed on right upper portions of the front wall 701 and the rear wall 702 respectively. The pair of guide rollers 705 has a function of guiding the cleaning unit 70 when the cleaning unit 70 moves to the cleaning position, the separation position, and the mounting and removing position described above.

The cleaning part 70A includes the web W, and the web driven roller 71 (feed-out roller), the pressing roller 72, and the web drive roller 73 (take-up roller) that are supported rotatably by the front wall 701 and the rear wall 702. The web W is a strip-shaped member forming the above contact surface WA, which comes in contact with the surface of the resist lower roller 32 to clean up the surface. A feed-out distal end of the web W is put over an outer peripheral surface of the pressing roller 72 and then is fixed to an outer peripheral surface of the web drive roller 73.

As described above, the web W of a strip shape is reeled out from the web roll WR fitted on the web driven roller 71. The web roll WR is arranged such that an amount of the remaining web W can be visually recognized from the outside of the cleaning unit 70 through an opening portion formed between the side wall 703A and the bottom wall 703B. This prevents a case where the cleaning unit 70 having been removed from the apparatus body 10 during use of the image forming apparatus 1 because of having a little amount of the remaining web W to be used is mounted erroneously on the apparatus body 10.

The pressing roller 72 is in contact with a back surface of the web W and presses a front surface of the web W against the resist lower roller 32. On a movement path of the web W, the pressing roller 72 lies at a midpoint between the web driven roller 71 and the web drive roller 73. The pressing roller 72 is an elastic roller constructed by fitting an elastic material on a peripheral surface of a shaft. A structure of the pressing roller 72 will be described in detail with reference to FIG. 13. When the cleaning unit 70 is disposed at the above cleaning position (FIG. 2), the pressing roller 72 is brought into contact with the resist lower roller 32 with the web W sandwiched between the pressing roller 72 and the resist lower roller 32. At this time, a center of the pressing roller 72 is on the straight line L. The above contact surface WA is a contact portion where the web W comes in contact with the resist lower roller 32, the contact portion being a part of a nip portion formed between the pressing roller 72 and the resist lower roller 32 so as to be on the straight line L, and is a strip-shaped portion extending in the front-rear direction.

The web driven roller 71 is a roller that can be driven to rotate around an axis of a driven roller shaft 71S. The web driven roller 71 feeds out the web W so as to cause a part of the web W that comes in contact with the resist lower roller 32 to shift. The web drive roller 73 takes up the web W having been fed out from the web driven roller 71. The web drive roller 73 is a roller that rotates around an axis of a drive roller shaft 73S, which is supplied with a rotational drive force from a drive system.

The cleaning unit 70 has a unit input gear 711 (see FIG. 4), an interlocking gear 711T, a transmission gear 712, and a drive roller gear 713 (see FIG. 6), which make up the above drive system. The unit input gear 711 is rotatably supported at a lower right end portion of the front wall 701. An input gear shaft 711S of the unit input gear 711 penetrates the front wall 701 and extends to the inside (back side) of the front wall 701. The interlocking gear 711T is fixed to the input gear shaft 711S, and rotates integrally with the unit input gear 711. The transmission gear 712 is rotatably supported inside the front wall 701, and is engaged with the interlocking gear 711T and with the drive roller gear 713. The drive roller gear 713 is a gear fixed to one end portion of the web drive roller 73.

The web W is fed out by a predetermined amount from the web roll WR at predetermined timing, by the web feed-out mechanism. This process is not described in detail. The web feed-out mechanism has a function of giving the drive roller shaft 73S a rotational drive force to feed out the web W. The web feed-out mechanism includes a solenoid that serves as a driving source, and a drive transmission system that coverts an extending and retracting motion of an extendable and retractable shaft of the solenoid into a torque and that transmits the torque to the unit input gear 711.

<Forms of Movement of Cleaning Unit>

Figure 7:
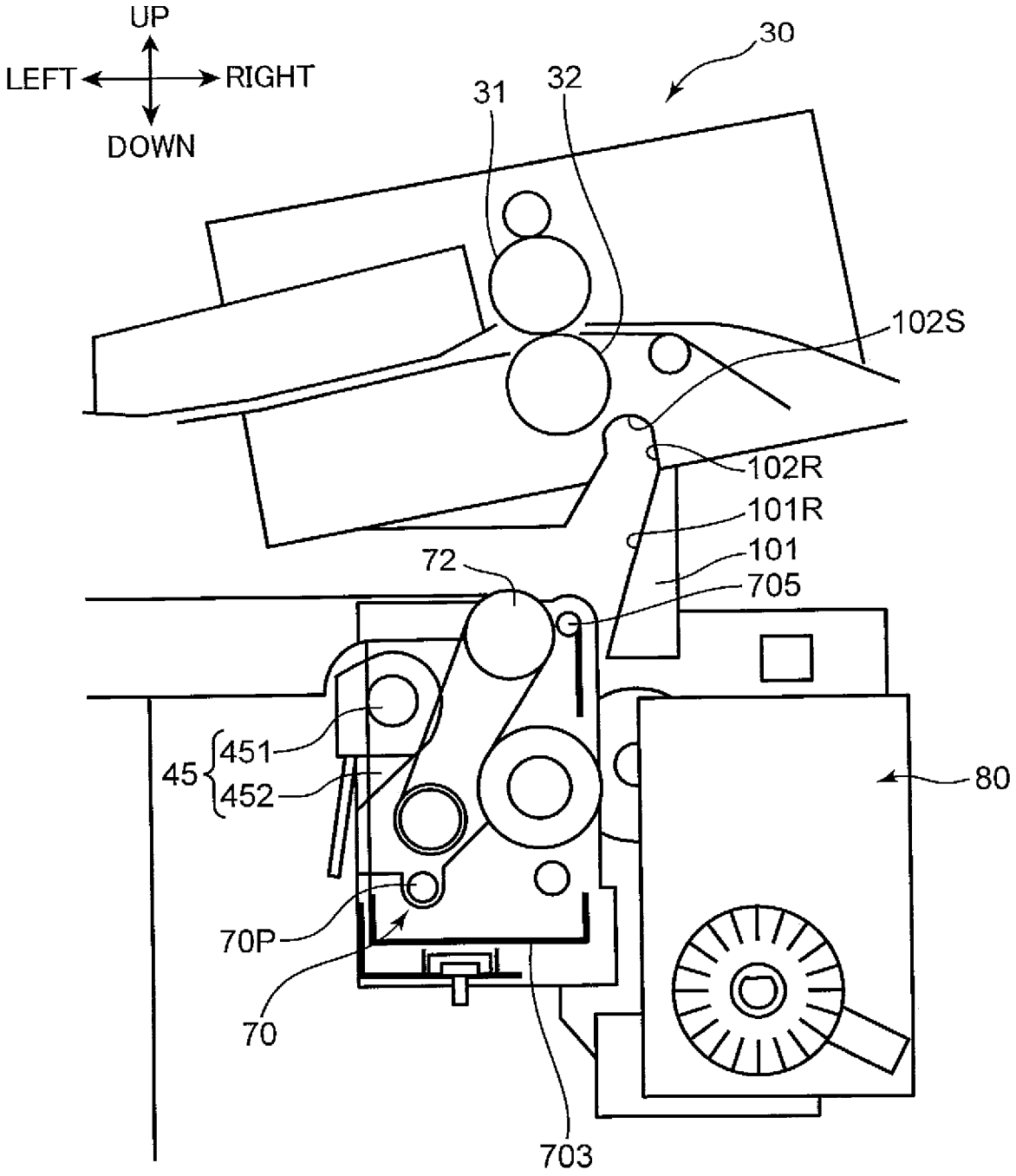
FIG. 7 shows the resist roller unit and the cleaning unit in a state where the cleaning unit is at a mounting and removing position.
Figure 8:
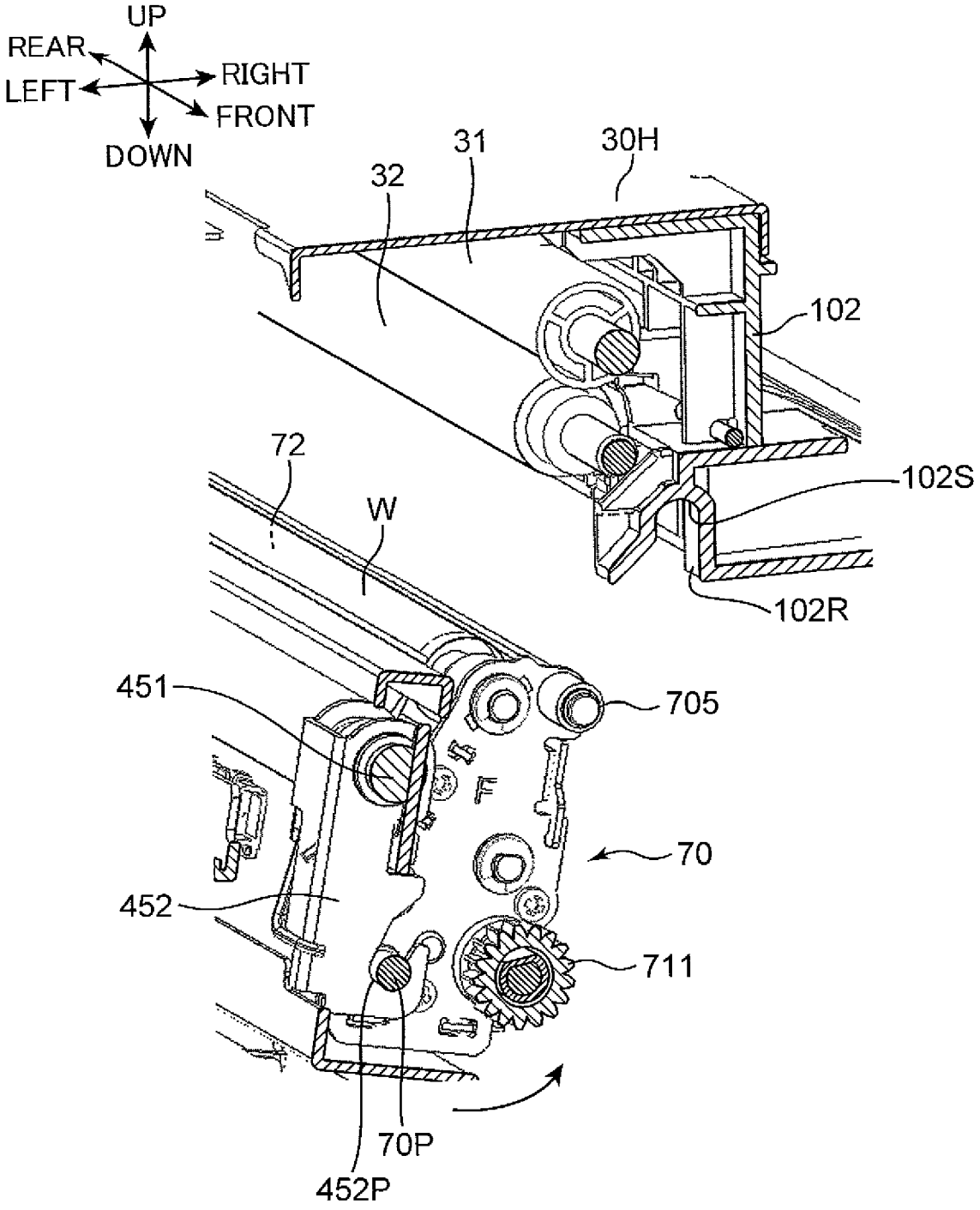
FIG. 8 is a partial cross-sectional view showing the resist roller unit and the cleaning unit in a state where the cleaning unit is slightly pushed up in a right diagonal direction, from the mounting and removing position.
Figure 9:
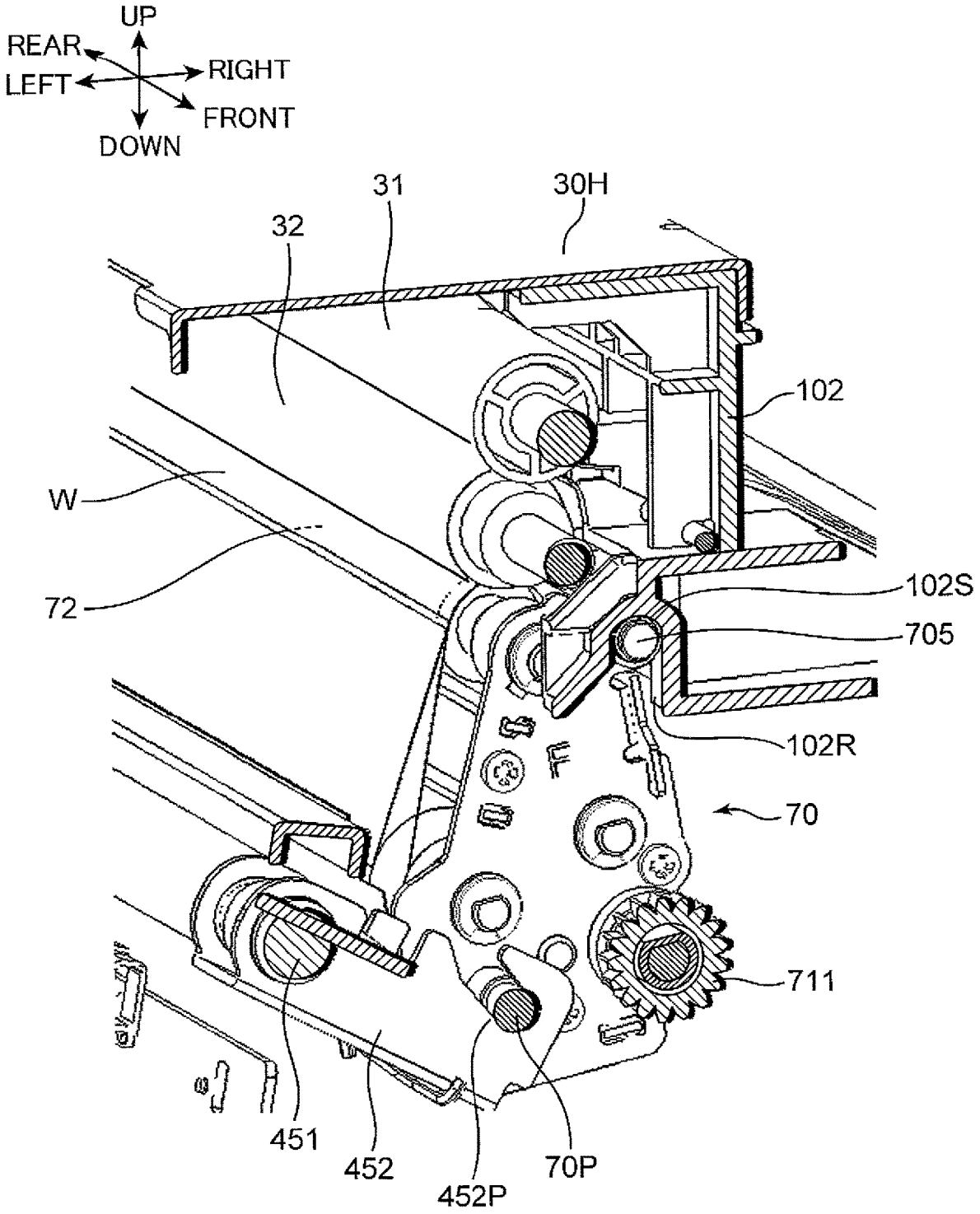
FIG. 9 is a partial cross-sectional view showing the resist roller unit and the cleaning unit in a state where the cleaning unit is at a cleaning position.

As described above, the cleaning unit 70 of the image forming apparatus 1 according to the present embodiment can be moved among the cleaning position, the separation position, and the mounting and removing position. Forms of movement of the cleaning unit 70 to respective positions will be described with reference to FIGS. 7 to 9. FIG. 7 shows the cleaning unit 70 and its surroundings in a state where the cleaning unit 70 is at the mounting and removing position. FIG. 8 is a partial cross-sectional view showing the resist roller unit 30 and the cleaning unit 70 in a state where the cleaning unit 70 is slightly pushed up in an upper diagonal direction, from the mounting and removing position, and FIG. 9 is a partial cross-sectional view showing the resist roller unit 30 and the cleaning unit 70 in a state where the cleaning unit 70 is at the cleaning position.

As shown in FIG. 8, the unit fulcrum pins 70P of the cleaning unit 70 are engaged with the pin receiving portions 452P formed on parts of rotary levers 452 that are close to their distal ends, respectively. As a result of the rotary shaft 451 being rotatably driven by the drive motor (not shown) included in the unit driving unit 80, the distal ends of the rotary levers 452 rotate counterclockwise. The cleaning unit 70 is thus pushed up in the right diagonal direction in a movement interlocked with the rotation of the rotary levers 452. When the rotary shaft 451 is driven to rotate in reverse, the rotary levers 452 rotate clockwise, which causes the cleaning unit 70 to move down leftward.

The unit fulcrum pins 70P of the cleaning unit 70 are disposed below and left to a center of gravity of the cleaning unit 70. As a result, when the cleaning unit 70 is pushed up, the cleaning unit 70 takes an orientation where an upper part of the cleaning unit 70 tilts rightward.

As shown in FIG. 7, guide frames 101 are provided in a part that is between the resist roller unit 30 and the unit driving unit 80 and that is above the cleaning unit 70 in the right diagonal direction. On respective left side portions of the guide frames 101, guide surfaces 101R are formed as sloped surfaces. The guide surfaces 101R are guide surfaces for guiding the pair of guide rollers 705, which are disposed on a right upper corner of the cleaning unit 70, to guide surfaces 102R formed on a lower part of the resist frame 102.

When the cleaning unit 70 at the mounting and removing position (FIG. 2) is pushed up by the rotation of the rotary levers 454, the cleaning unit 70 tilts rightward because of the above-described positional difference between the unit fulcrum pins 70P and the center of gravity. This brings the pair of guide rollers 705 into contact with the guide surfaces 101R, along which the guide rollers 705 are guided. Then, when the rotary levers 454 rotate further, the pair of guide rollers 705, which have been guided along the guide surfaces 101R and the guide surfaces 102R, are pushed into positioning portions 102S of the resist frame 102 (see FIG. 9). At a point of time at which the pair of guide rollers 705 are pushed into the positioning portions 102S, the cleaning unit 70 is disposed at the cleaning position and is stopped from moving relative to the resist roller unit 30.

The separation position of the cleaning unit 70 refers to an intermediate position of the cleaning unit 70, the intermediate position being located between the position of the cleaning unit 70 shown in FIG. 8 and the same shown in FIG. 9. The separation position can be set properly as any given position at which the web W is separated from the resist lower roller 32.

<Cleaning Process by Cleaning Unit>

Figure 10:
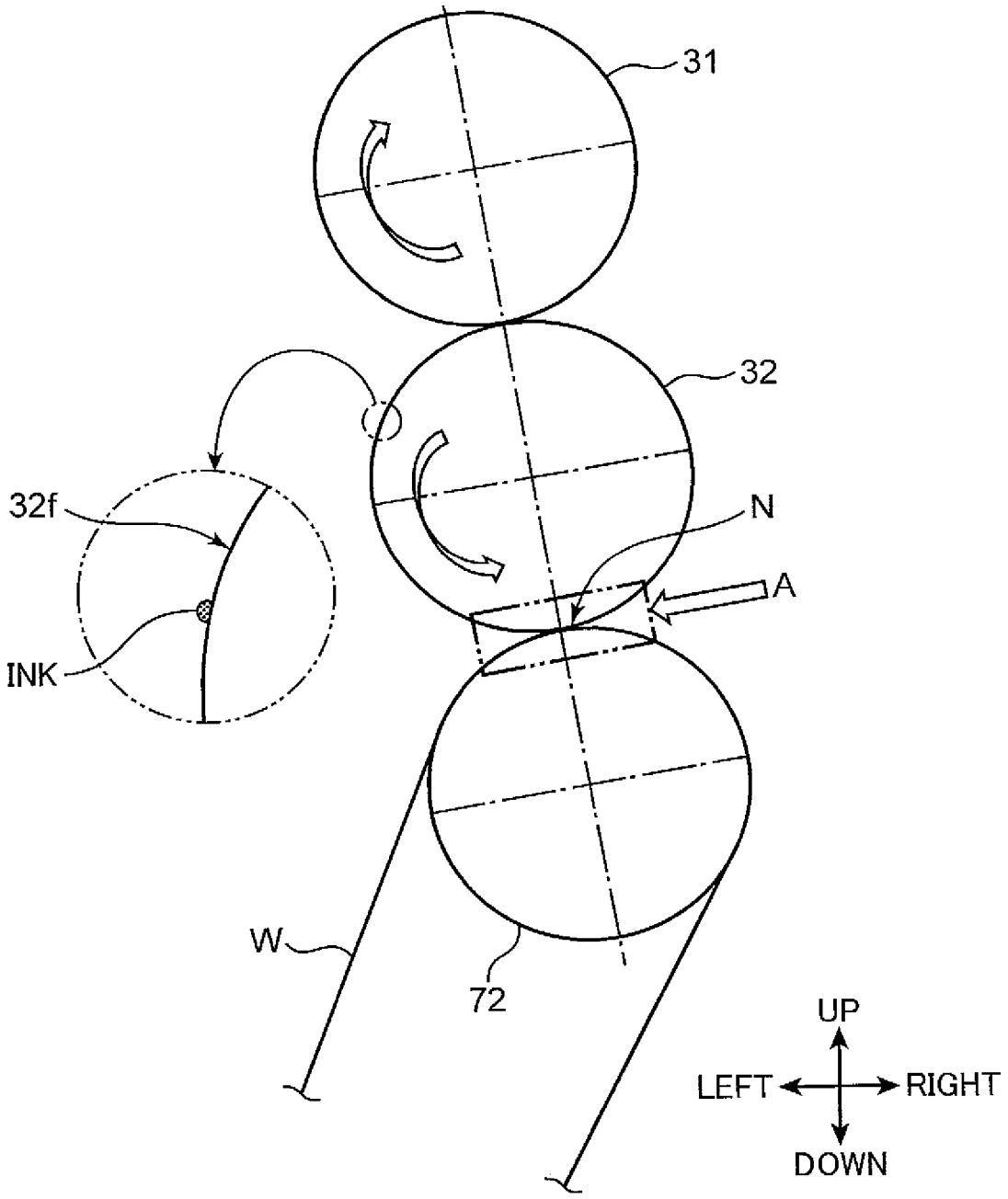
FIG. 10 is a schematic view showing a resist upper roller, a resist lower roller, a pressing roller, and a web.
Figure 11:
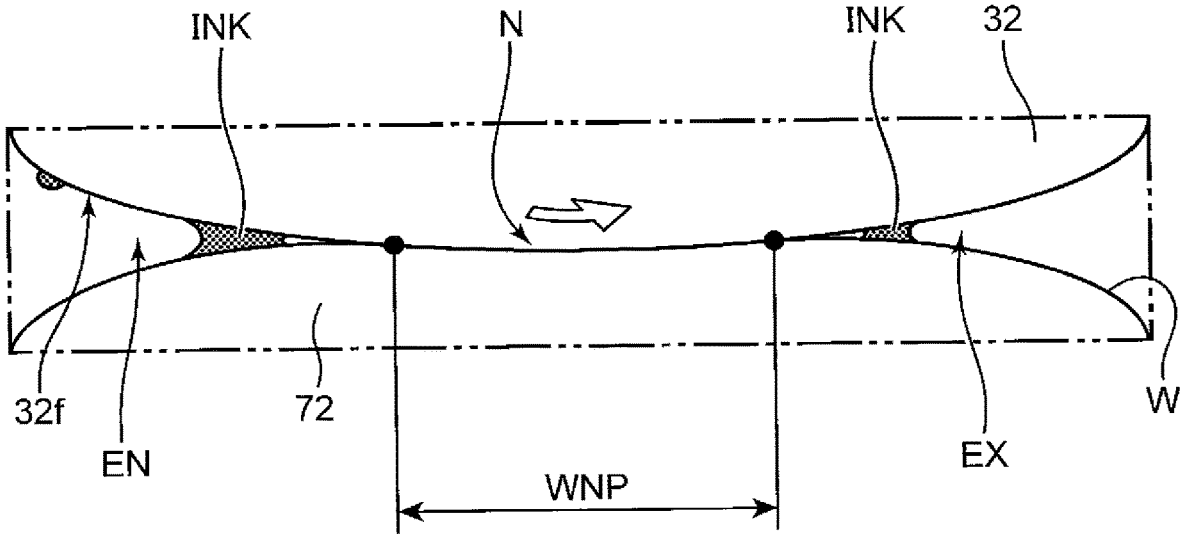
FIG. 11 is a schematic view showing a part where the resist lower roller and the web are in contact with each other.

A cleaning process of cleaning the surface of the resist lower roller 32 by the cleaning unit 70 will be described with reference to FIGS. 10 and 11. FIG. 10 is a schematic view showing the resist lower roller 32, the pressing roller 72, and the web W in a state where the cleaning unit 70 is at the cleaning position. FIG. 11 is an enlarged view of a part A shown in FIG. 10.

As shown in FIG. 10, when the sheet S carrying an image formed on its one surface is reversed to switch its front and back surfaces to each other and is conveyed into the resist roller unit 30, ink INK adheres to a surface 32*f* of the resist lower roller 32 in some cases. When the cleaning unit 70 is at the cleaning position, the pressing roller 72 is pressed against the resist lower roller 32 such that a part of an outer peripheral portion of the pressing roller 72 elastically deform inwardly in a radial direction in a state where the web W is sandwiched between the pressing roller 72 and the resist lower roller 32. In the present embodiment, for example, the pressing roller 72 is pressed at a pressure of 10 to 15 gf/mm$^2$ (9.81 e+7 to 1.478e+8 Pa), against the resist lower roller 32.

As shown in FIG. 11, rotation of the resist lower roller 32 results in a relative movement of the web W to a roller surface 32*f* of the resist lower roller 32. In the present embodiment, the resist lower roller 32 is rotated in the above-described state where the part of the outer peripheral portion of the pressing roller 72 is elastically deformed in the radial direction. As a result, a state of contact of the web W with the surface 32*f* of the resist lower roller 32 is not line contact (line contact in a direction orthogonal to the paper surface in FIG. 11) but becomes surface contact having a nip width WNP.

In this manner, as a result of the relative movement of the web W to the roller surface 32*f*, the ink INK adhering to the roller surface 32*f* reaches a nip entrance EN of a cleaning nip N formed between the pressing roller 72 and the resist lower roller 32, where the web W is pressed by the pressing roller 72 to come in contact with the resist lower roller 32. The ink INK is then blocked at the nip entrance EN, thus forming an ink puddle there. Afterward, most of the ink INK adhering to the roller surface 32*f* is absorbed by the web W in a contact area between the roller surface 32*f* and the web W.

However, a tiny portion of the ink INK adhering to the roller surface 32*f* passes through the cleaning nip N, that is, the contact area between roller surface 32*f* and the web W, thus coming out of a cleaning nip exit EX, as a portion of the ink INK staying on the roller surface 32*f* Specifically, there may be a case where the ink INK, due to its surface tension, infiltrates into a tiny gap between the pressing roller 72 and the web W and slips through the cleaning nip N. The ink INK that is not absorbed by the web W at the cleaning nip N to stay on the roller surface 32*f* in the above manner dries and solidifies as time goes by, and, consequently, a pigment or the like included in the ink INK sticks firmly to the roller surface 32*f*.

Such ink INK sticking firmly to the roller surface 32*f* is also wiped away certainly by the web W when the web W is brought into contact with the sticking ink INK as a result of the rotation of the resist lower roller 32. Specifically, as shown in FIG. 11, at the time of cleaning the roller surface 32*f*, the part of the outer peripheral portion of the pressing roller 72 is caused to deform elastically in the radial direction to form the nip width WNP relatively long in a roller rotation direction. A state of contact of the web W with the roller surface 32*f* is thus made surface contact state, in which the firmly sticking ink INK can be wiped away by the web W frictionally sliding over the roller surface 32*f*.

When a cleaning process as described above is completed, the web drive roller 73 is rotatably driven (see FIG. 6) to feed out the web W. This creates a state where at the next round of the cleaning process, a new part of the surface of the web W is allowed to come in contact with the resist lower roller 32.

<Structure of Resist Lower Roller and of Pressing Roller>

Figure 12:
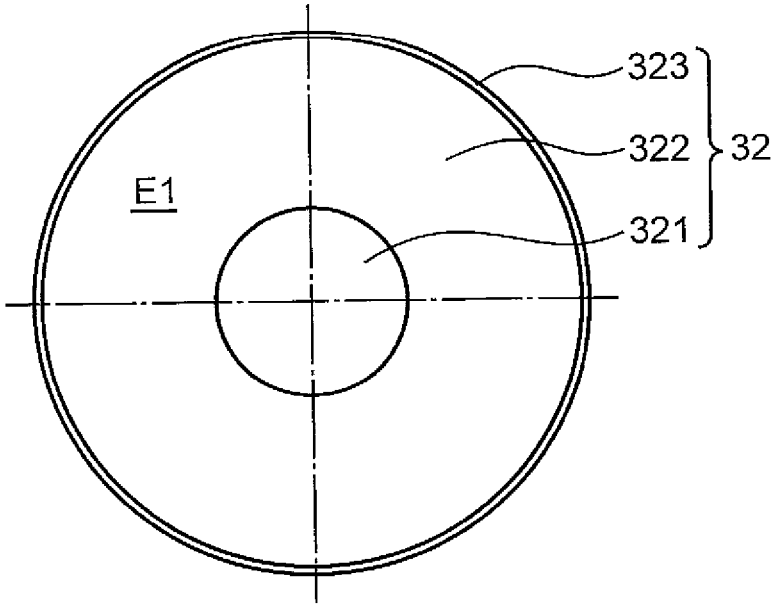
FIG. 12 shows the resist lower roller.
Figure 13:
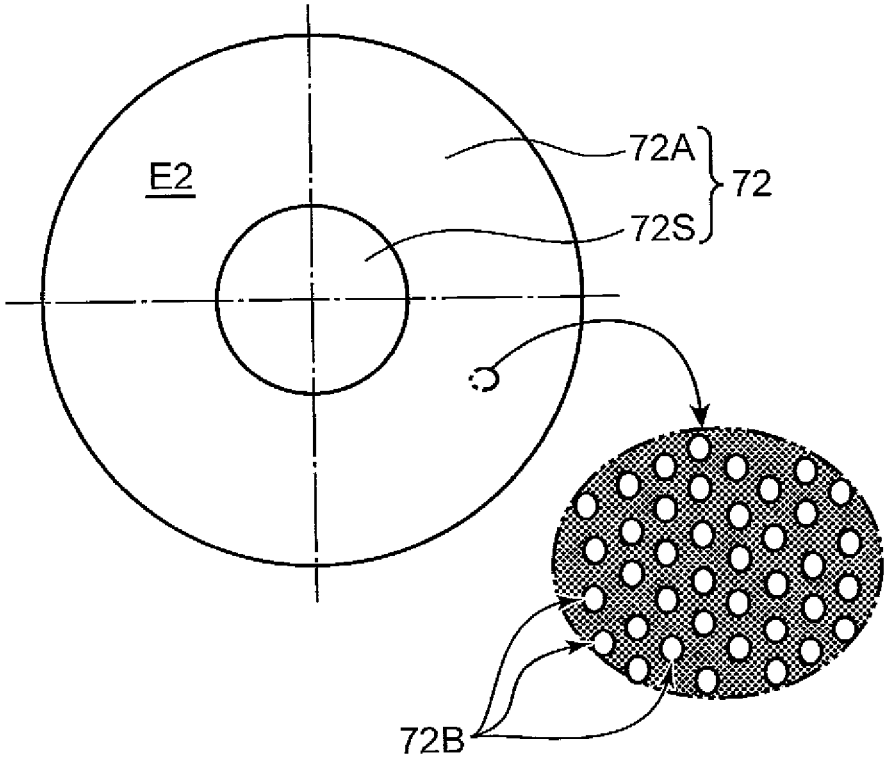
FIG. 13 shows the pressing roller.

A structure of the resist lower roller 32 and of the pressing roller 72 will then be described in detail. FIG. 12 is a cross-sectional view of the resist lower roller 32, and FIG. 13 is a cross-sectional view of the pressing roller 72.

As shown in FIG. 12, the resist lower roller 32 includes a first core portion 321, a first outer peripheral portion 322 covering an outer periphery of the first core portion 321, and an outer skin layer 323 covering a surface of the first outer peripheral portion 322. The first core portion 321, as in the case of the resist upper roller 31, is composed of, for example, a shaft made of a metal, such as an aluminum alloy.

The first outer peripheral portion 322 is formed of a solid rubber layer. For example, a rubber, such as ethylene-propylene diene (EPDM) rubber, can be used as a material making up the rubber layer. The first outer peripheral portion 322 of the resist lower roller 32 is required to have rigidity that hardly allows the resist lower roller 32 to deform in the radial direction so that the resist lower roller 32 can nip the sheet S along with the resist upper roller 31 and convey the sheet S at an accurate linear velocity. It is preferable, for this reason, that a Young's modulus E1 of the first outer peripheral portion 322 be set as a Young's modulus within a range of about 4.3 MPa or more and about 6.27 MPa or less.

The outer skin layer 323 is formed of a highly water-repellent, thin-walled tube made of, for example, a tetrafluoroethylene-perfluoroalkoxy ethylene copolymer resin (PFA). Providing the resist lower roller 32 with such an outer skin layer 323 enhances smoothness of a peripheral surface of the resist lower roller 32. As a result, the web W easily absorbs the ink INK adhering or firmly sticking to the peripheral surface of the resist lower roller 32.

As shown in FIG. 13, the pressing roller 72 is an elastic roller that includes a second core portion 72S serving as a rotating shaft of the pressing roller 72, and a second outer peripheral portion 72A covering an outer periphery of the second core portion 72S. The pressing roller 72 elastically deforms to dent inwardly in the radial direction when pressing the web W against the surface 32*f* of the resist lower roller 32.

The second core portion 72S is a metal shaft, and may be provided as, for example, a shaft made of an iron solid material. Similar to the above first outer peripheral portion 322 of the resist lower roller 32, the second outer peripheral portion 72A is made of, for example, a rubber, such as ethylene-propylene diene (EPDM) rubber. As shown in an enlarged view of FIG. 13, however, the second outer peripheral portion 72A of the pressing roller 72 is made of a foamed rubber (sponge) containing a number of pores 72B. In other words, the second outer peripheral portion 72A making up a part of the pressing roller 72 is made of an elastic material having an air bubble ratio higher than an air bubble ratio of the first outer peripheral portion 322 of the resist lower roller 32.

Having the second outer peripheral portion 72A made of the foamed rubber in this manner, the pressing roller 72 works as a roller including a low Young's modulus area formed at least on its part in the radial direction. A Young's modulus E2 of the second outer peripheral portion 72A is set as a Young's modulus that is 1/1000 or more and 1/10 or less, more preferably, 1/100 or more and 1/10 or less of a Young's modulus E1 of the first outer peripheral portion 322 of the resist lower roller 32. A specific value for the Young's modulus E2 of the second outer peripheral portion 72A of the pressing roller 72 can be selected from, for example, values ranging from 0.04 MPa to 0.6 MPa (inclusive).

<Effects>

The cleaning unit 70 (cleaning device) according to the first embodiment is a cleaning mechanism that cleans the roller surface 32*f* (surface) of the resist lower roller (sheet conveyance roller) 32 included in the resist roller unit 30 (sheet conveyance unit) that conveys the sheet S to the image forming unit 50. The image forming unit 50 executes the image forming processing, using the ink INK (recording member). The cleaning unit 70 has the web W (cleaning member) that can come in contact with the roller surface 32*f* of the resist lower roller 32, and the pressing roller 72 that presses the web W against the roller surface 32*f* of the resist lower roller 32. The pressing roller 72 includes the low Young's modulus area (second outer peripheral portion 72A) formed at least on a part of the pressing roller 72 in the radial direction, the low Young's modulus area having the Young's modulus lower than the Young's modulus of the resist lower roller 32. When the roller surface 32*f* of the resist lower roller 32 is cleaned, the pressing roller 72 is pressed against the resist lower roller 32 so as to elastically deform in the radial direction in a state where the web W is sandwiched between the pressing roller 72 and the resist lower roller 32.

As a result of setting the Young's modulus E2 of the pressing roller 72 (second outer peripheral portion 72A) lower than the Young's modulus E1 of the resist lower roller 32 (first outer peripheral portion 322), when the roller surface 32*f* is cleaned, the pressing roller 72 pressed against the resist lower roller 32 elastically deforms to dent inwardly in the radial direction. As a result, at cleaning of the roller surface 32*f*, a state of contact of the web W with the resist lower roller 32 is not line contact but becomes surface contact having the large nip width WNP. The pressing roller 72 is pressed against the surface 32*f* of the resist lower roller 32 by a predetermined pressing force (e.g., 10 to 15 $gf/mm^2$). This brings the web W into contact with the surface 32*f* such that a high frictional force acts between the web W and the surface 32*f* Even if the ink INK sticks firmly to the roller surface 32*f* of the resist lower roller 32, therefore, the sticking ink INK can be wiped away by the web W frictionally sliding over the roller surface 32*f*.

The present embodiment is to meet a requirement that elastic deformation of the resist lower roller 32 be prevented as much as possible to allow the sheet S to be conveyed accurately at a predetermined linear velocity. In view of this requirement, the Young's modulus E1 of the resist lower roller 32 is not made relatively low but the Young's modulus E2 of the pressing roller 72 is made relatively low.

In the present embodiment, the resist lower roller 32 is configured to include the first core portion 321 and the first outer peripheral portion 322, and the pressing roller 72 is configured to include the second core portion 72S and the second outer peripheral portion 72A. The Young's modulus E2 of the outer peripheral portion 72A of the pressing roller 72 is set lower than the Young's modulus E1 of the first outer peripheral portion 322 of the resist lower roller 32. As the first core portion 321 and the second core portion 72S pivotally and firmly support the resist lower roller 32 and the pressing roller 72, respectively, therefore, the second outer peripheral portion 72A of the pressing roller 72 is caused to elastically deform when the pressing roller 72 is pressed.

The second outer peripheral portion 72A is configured to have the air bubble ratio higher than the air bubble ratio of the first outer peripheral portion 322. Setting a difference in air bubble ratio in this manner allows a wider range of material selection, and allows the second outer peripheral portion 72A of the pressing roller 72 to elastically deform in the radial direction when the roller surface 32*f* is cleaned. In the present embodiment, the first outer peripheral portion 322 has a solid structure. The resist lower roller 32, however, may be made into a structure having a few pores. It is necessary, however, that the first outer peripheral portion 322 of the resist lower roller 32 have an air bubble ratio set lower than the air bubble ratio of the second outer peripheral portion 72A of the pressing roller 72. The second outer peripheral portion 722 and the first outer peripheral portion 322 are made of the same material (EPDM), except for a difference in air bubble ratio. Obviously, however, the second outer peripheral portion 722 and the first outer peripheral portion 322 may be made respectively of different materials.

In the cleaning unit 70 according to the present embodiment, E2/E1 is set in a range of 1/1000 or more and 1/10 or less, more preferably, in a range of 1/100 or more and 1/10 or less. As a result, when the pressing roller 72 is pressed (to clean the roller surface 320, the second outer peripheral portion 72A of the pressing roller 72 is certainly caused to elastically deform as deformation of the first outer peripheral portion 322 of the resist lower roller 32 is inhibited, and the pressing force that presses the web W against the resist lower roller 32 is kept high.

The image forming apparatus 1 according to the present embodiment has been described as the image forming apparatus that includes the sheet reversing unit 15 to offer the both-side printing function. In the image forming apparatus 1 having the both-side printing function, the ink INK used in the preceding image forming processing tends to adhere to the roller surface 32*f* of the resist lower roller 32 and, as time goes by, firmly sticks to the roller surface 32*f* in some cases. In such a case, the cleaning unit 70 having the above configuration causes the web W to certainly remove the ink INK firmly sticking to the roller surface 32*f* of the resist lower roller 32 by frictionally sliding over the roller surface 32*f*.

Second Embodiment

Figure 14:
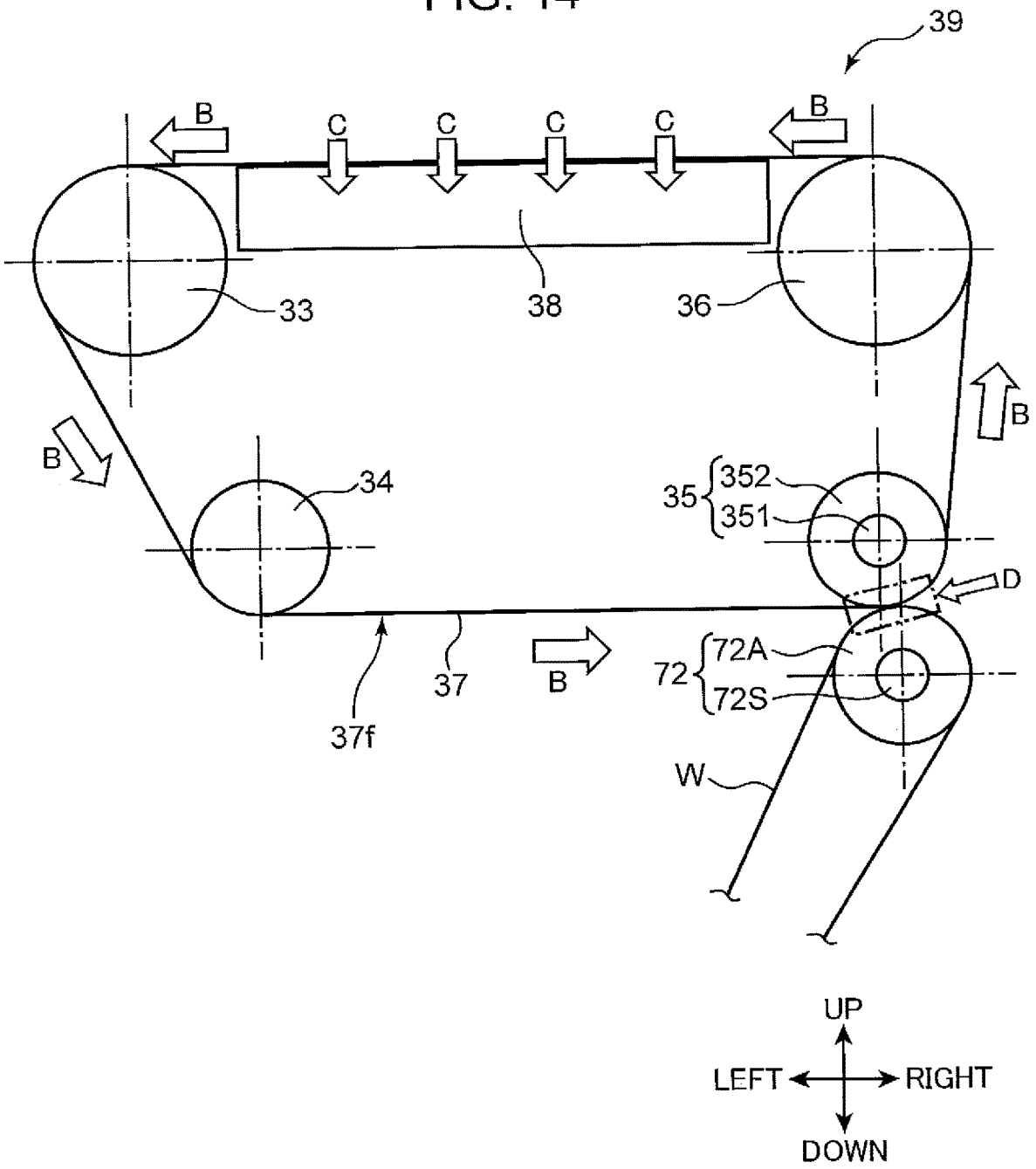
FIG. 14 is a schematic view showing a structure of a sheet conveyance unit and the cleaning unit in an image forming apparatus according to a second embodiment of the present disclosure.

FIG. 14 shows a sheet conveying unit (sheet conveyance unit) 39 that is a constituent element of an image forming apparatus according to a second embodiment of the present disclosure and that makes the image forming apparatus according to the second embodiment different from the image forming apparatus according to the first embodiment. The image forming apparatus according to the present embodiment is the same in configuration as the image forming apparatus 1 according to the first embodiment, except for the sheet conveying unit 39 shown in FIG. 14.

In the first embodiment, the resist roller unit 30 is described as an example of the sheet conveyance unit that conveys the sheet S to the belt conveyance unit 40. In the second embodiment, on the other hand, the sheet conveying unit 39 is adopted as another example of the sheet conveyance unit, the sheet conveying unit 39 including a plurality of support rollers (first to fourth support rollers 33 to 36), a feed-out belt 37, and a suction unit 38.

As shown in FIG. 14, the first support roller 33 and the fourth support roller 36 are disposed to be separated from each other across a distance in the left-right direction. The first support roller 33 and the fourth support roller 36 each extend in the front-rear direction (the direction orthogonal to the paper surface in FIG. 14). In the present embodiment, for example, the first support roller 33 is a drive roller and the fourth support roller 36 is a belt speed detection roller.

The second support roller 34 is disposed below the first support roller 33 in a right diagonal direction. The third support roller 35 is disposed below the fourth support roller 36, and is disposed right with respect to the second support roller 34 with a predetermined distance formed between the second support roller 34 and the third support roller 35.

The feed-out belt 37 is supported in an extended manner between the four support rollers 33 to 36 so as to have no slackness. Being driven by the rotation of the first support roller 33, the feed-out belt 37 orbits in a direction indicated by arrows B. Inside an orbital path of the feed-out belt 37, the suction unit 38 having the same configuration as the configuration of the suction unit 43 according to the first embodiment is provided. The feed-out belt 37 has a plurality of holes penetrating the feed-out belt 37 in its thickness direction, which holes will not be described in detail. Through these holes, the sheet S placed on a belt surface (outer peripheral surface) 37*f* of the feed-out belt 37 is sucked in a direction indicated by arrows C.

In a state where the cleaning unit according to the present embodiment is disposed at the cleaning position, the pressing roller 72 presses the third support roller 35 (one support roller), with the web W and the feed-out belt 37 being sandwiched between the pressing roller 72 and the third support roller 35. This brings the belt surface 37*f* of the feed-out belt 37 into contact with the web W.

The third support roller 35, similar to the resist lower roller 32 according to the first embodiment, includes a third core portion 351, and a third outer peripheral portion 352 covering an outer periphery of the third core portion 351. This third outer peripheral portion 352 is made of a solid rubber, such as an EPDM rubber. Similar to the pressing roller 72 of the first embodiment, the pressing roller 72 of the second embodiment is an elastic roller that includes the second core portion 72S (fourth core portion), and the second outer peripheral portion 72A (fourth outer peripheral portion) covering an outer periphery of the second core portion 72S. The second outer peripheral portion 72A is a low Young's modulus area made of a foamed rubber (sponge) containing a number of pores 72B, showing a Young's modulus lower than a Young's modulus of the third support roller 35 against which the second outer peripheral portion 72A is pressed when the belt surface 37*f* is cleaned.

Specifically, when a Young's modulus of the third outer peripheral portion 352 of the support roller 35 is E1 and a Young's modulus of the second outer peripheral portion 72A of the pressing roller 72 is E2, E2/E1 is set in a range of 1/1000 or more and 1/10 or less (more preferably, in a range of 1/100 or more and 1/10 or less). Because of such a difference in Young's modulus, when the belt surface 37*f* is cleaned, the pressing roller 72 elastically deform such that a part of its outer peripheral portion 72A dents inwardly in the radial direction, which brings the web W into surface contact with the belt surface 37*f* of the feed-out belt 37 (part indicated by an arrow D).

According to the second embodiment, the Young's modulus E2 of the second outer peripheral portion 72A of the pressing roller 72 is set lower than the Young's modulus E1 of the third support roller 35. When the belt surface 37*f* of the feed-out belt 37 (sheet conveyance belt) is cleaned, the pressing roller 72 is pressed against the third support roller 35 so as to elastically deform in the radial direction in a state where the web W and the feed-out belt 37 are sandwiched between the pressing roller 72 and the third support roller 35.

As a result of setting the Young's modulus E2 of the pressing roller 72 (second outer peripheral portion 72A) lower than the Young's modulus E1 of the third support roller 35 (third outer peripheral portion 352), when the belt surface 37*f* is cleaned, the pressing roller 72 pressed against the third support roller 35 elastically deforms to dent inwardly in the radial direction. As a result, at cleaning of the belt surface 37*f*, a state of contact of the web W with the feed-out belt 37 is not line contact but becomes surface contact having a large contact width. The pressing roller 72 is pressed against the belt surface 37*f* of the feed-out belt 37 by a predetermined pressing force (e.g., 10 to 15 gf/mm$^2$). This brings the web W into contact with the belt surface 37*f* such that a high frictional force acts between the web W and the belt surface 37*f*. In this configuration, even if the ink INK adheres to the belt surface 37*f* of the feed-out belt 37 and sticks firmly to the belt surface 37*f* as time goes by, the firmly sticking ink INK can be wiped away by the web W.

If not the Young's modulus E2 of the pressing roller 72 but the Young's modulus E1 of the third support roller 35 is made relatively low, the third support roller 35 elastically deforms when the pressing roller 72 is pressed against the support roller 35 at cleaning of the belt surface 37*f* This may lead to slackening of the feed-out belt 37. In another case, applying a tensile force to the feed-out belt 37 causes the third support roller 35 to deform elastically. This case may also lead to slackening of the feed-out belt 37. In this manner, when not the Young's modulus of the pressing roller 72 but the Young's modulus of the third support roller 35 is made relatively low, the ink INK firmly sticking to the belt surface 37*f* of the feed-out belt 37 is not wiped away effectively by the web W frictionally sliding over the belt surface 37*f*, and accurately conveying the sheet S in the sheet conveyance process becomes difficult. For these reasons, according to the second embodiment, the Young's modulus E2 of the pressing roller 72 is made relatively low.

[Modifications]

The embodiments of the present disclosure have been described above. The present disclosure is, however, not limited to these embodiments but may be embodied as the following modified embodiments.

(1) In the above first and second embodiments, the water-based ink is adopted as an example of the recording material. The present disclosure, however, is not limited by this. For example, non-water-based ink or toner may also be adopted as the recording material. When toner is adopted as the recording material, however, the toner adheres to the surface of the sheet conveyance member, cools and solidifies, and sticks firmly to the surface of the sheet conveyance member in some cases, as the water-based ink does. In such a case, by adopting the cleaning unit 70 having the configuration of the first embodiment or the second embodiment, the same effect as described above can be achieved.

(2) In the first and second embodiments, the web W is reeled out from the web roll WR and is taken up by the web drive roller 73. The present disclosure, however, is not limited by this. For example, a configuration may be adopted according to which a web of a strip sheet shape is brought into contact with the sheet conveyance member and is replaced with another web at predetermined timing.

(3) In the first and second embodiments, the image forming apparatus 1 including the sheet reversing unit 15 is adopted. According to the present disclosure, however, an image forming apparatus not including the sheet reversing unit may also be adopted. Such an image forming apparatus not including the sheet reversing unit may be configured to allow an operation that the user reverses the sheet carrying an image formed on its one surface and places the reversed sheet on a hand-feeding tray (paper supply tray) to form an image on the other surface. In this case, the recording material may stick firmly to the sheet conveyance member, as does in the above case. In such a case, however, a cleaning device, such as the above cleaning unit 70, certainly removes the recording material sticking firmly to the sheet conveyance member, through the frictional sliding of the web W.

(4) The first embodiment has been described above as an example in which the resist lower roller 32 includes the first core portion 321 and the first outer peripheral portion 322, while the pressing roller 72 includes the second core portion 72S and the second outer peripheral portion 72A. The second embodiment, on the other hand, has been described above as an example in which the third support roller 35 includes the third core portion 351 and the third outer peripheral portion 352. Each of the sheet conveyance roller, the support roller, and the pressing roller may be a roller of an integral structure made of a single material.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A cleaning device comprising:

a sheet conveyance roller that conveys a sheet in an image forming apparatus that executes image forming processing, using a recording member; and a cleaning unit that cleans a surface of the sheet conveyance roller, wherein the cleaning unit includes:

a cleaning member configured to come in contact with the surface of the sheet conveyance roller; and a pressing roller that presses the cleaning member against the surface of the sheet conveyance roller, the pressing roller includes a low Young's modulus area formed at least on a part of the pressing roller in a radial direction, the low Young's modulus area having a Young's modulus lower than a Young's modulus of the sheet conveyance roller, and when the surface of the sheet conveyance roller is cleaned, the pressing roller is pressed against the sheet conveyance roller so as to elastically deform in the radial direction in a state where the cleaning member is sandwiched between the pressing roller and the sheet conveyance roller, and wherein when a Young's modulus of a first outer peripheral portion of the sheet conveyance roller is E1 and a Young's modulus of a second outer peripheral portion of the pressing roller is E2, E2/E1 is 1/1000 or more and 1/10 or less.

2. The cleaning device according to claim 1, wherein the sheet conveyance roller includes a first core portion and the first outer peripheral portion covering an outer periphery of the first core portion, and the pressing roller includes a second core portion and the second outer peripheral portion covering an outer periphery of the second core portion.

3. The cleaning device according to claim 2, wherein the second outer peripheral portion of the pressing roller has an air bubble ratio higher than an air bubble ratio of the first outer peripheral portion of the sheet conveyance roller.

4. The cleaning device according to claim 1, wherein E2/E1 is 1/100 or more and 1/10 or less.

5. The cleaning device according to claim 1, wherein the cleaning member is a strip-shaped web forming the contact surface that comes in contact with the sheet conveyance roller, and the cleaning unit includes:

the pressing roller;

a feed-out roller that feeds out the web so as to cause a part of the web that comes in contact with the sheet conveyance roller to shift; and a take-up roller that takes up the web.

6. An image forming apparatus comprising:

an image forming unit that executes image forming processing, using a recording material;

a sheet conveyance unit that conveys a sheet to the image forming unit, the sheet conveyance unit including a sheet conveyance member that comes in contact with the sheet; and the cleaning device according to claim 1.

7. The image forming apparatus according to claim 6, further comprising:

a sheet reversing unit that reverses the sheet carrying an image that is formed on one surface of the sheet at the image forming unit, the sheet reversing unit conveying the reversed sheet having a front surface and a back surface switched to each other, to the sheet conveyance unit, wherein the sheet conveyance member is disposed at a place where the sheet conveyance member comes in contact with the sheet carrying the image formed on the one surface.

8. A cleaning device comprising:

a sheet conveyance belt that conveys a sheet in an image forming apparatus that executes image forming processing, using a recording member; and a cleaning unit that cleans a surface of the sheet conveyance belt, wherein the sheet conveyance belt is supported in an extended manner between a plurality of support rollers, the cleaning unit includes:

a cleaning member configured to come in contact with the surface of the sheet conveyance belt; and a pressing roller that presses the cleaning member against one support roller out of the plurality of support rollers, the pressing roller includes a low Young's modulus area formed at least on a part of the pressing roller in a radial direction, the low Young's modulus area having a Young's modulus lower than a Young's modulus of the one support roller, and when the surface of the sheet conveyance belt is cleaned, the pressing roller is pressed against the one support roller so as to elastically deform in the radial direction in a state where the cleaning member and the sheet conveyance belt are sandwiched between the pressing roller and the one support roller, and wherein when a Young's modulus of a third outer peripheral portion of the one support roller is E1 and a Young's modulus of a fourth outer peripheral portion of the pressing roller is E2, E2/E1 is 1/1000 or more and 1/10 or less.

9. The cleaning device according to claim 8, wherein the one support roller includes a third core portion and the third outer peripheral portion covering an outer periphery of the third core portion, and the pressing roller includes a fourth core portion and the fourth outer peripheral portion covering an outer periphery of the fourth core portion.

10. The cleaning device according to claim 9, wherein the fourth outer peripheral portion of the pressing roller has an air bubble ratio higher than an air bubble ratio of the third outer peripheral portion of the one support roller.

11. The cleaning device according to claim 8, wherein E2/E1 is 1/100 or more and 1/10 or less.

12. The cleaning device according to claim 8, wherein the cleaning member is a strip-shaped web forming the contact surface that comes in contact with the sheet conveyance belt, and the cleaning unit includes:

the pressing roller;

a feed-out roller that feeds out the web so as to cause a part of the web that comes in contact with the sheet conveyance belt to shift; and a take-up roller that takes up the web.

* * * * *